United States Patent [19]

Gmelin

[11] Patent Number: 5,046,469

[45] Date of Patent: Sep. 10, 1991

[54] FUEL DISTRIBUTOR FOR FUEL INJECTION SYSTEMS OF INTERNAL COMBUSTION ENGINES

[75] Inventor: Karl Gmelin, Flein, Fed. Rep. of Germany

[73] Assignee: Robert Bosch GmbH, Stuttgart, Fed. Rep. of Germany

[21] Appl. No.: 463,575

[22] Filed: Jan. 11, 1990

[30] Foreign Application Priority Data

Mar. 10, 1989 [DE] Fed. Rep. of Germany ..... 3907765

[51] Int. Cl.[5] ..... F02M 61/14

[52] U.S. Cl. ..... 123/470; 123/468; 123/469; 277/206 R

[58] Field of Search ..... 123/468, 469, 470, 472; 277/206 R; 248/635, 638; 239/585, 600

[56] References Cited

U.S. PATENT DOCUMENTS

| | | | |
|---|---|---|---|
| 3,941,109 | 3/1976 | Schmid | 123/470 |
| 4,201,172 | 5/1980 | Jaggle | 123/470 |
| 4,348,032 | 9/1982 | Hanson | 277/206 R |
| 4,355,815 | 10/1982 | Dück | 277/206 R |
| 4,416,238 | 11/1983 | Knapp | 123/470 |
| 4,579,184 | 4/1986 | Hiramoto | 248/635 |
| 4,751,905 | 6/1988 | Bonfiglioli et al. | 123/470 |
| 4,844,036 | 7/1989 | Bassler et al. | 123/470 |
| 4,857,003 | 8/1989 | Hafner et al. | 439/130 |
| 4,860,710 | 8/1989 | Hafner et al. | 123/470 |
| 4,883,252 | 11/1989 | Mesenich | 123/472 |

FOREIGN PATENT DOCUMENTS 3730571 3/1989 Fed. Rep. of Germany .

*Primary Examiner*—Carl Stuart Milles
*Assistant Examiner*—Erick Solis
*Attorney, Agent, or Firm*—Edwin E. Greigg; Ronald E. Greigg

[57] ABSTRACT

A fuel distributor for fuel injection systems of internal combustion engines, having at least one fuel injection valve including a housing and a valve carrier that has at least one axial, open, stepped receiving bore that communicates with a fuel supply line, for the fuel injection valve. A bearing shoulder surrounds the receiving bore and the fuel injection valve is supported on the shoulder by a collar and is firmly fastened by an end holder. For acoustic decoupling of the fuel injection valve and the valve carrier, the collar is encompassed by a shaped ring of an elastomer material that fits over the collar on upper and lower face ends, at least in a vicinity of a bearing surface of the bearing shoulder and holder.

20 Claims, 1 Drawing Sheet

FUEL DISTRIBUTOR FOR FUEL INJECTION SYSTEMS OF INTERNAL COMBUSTION ENGINES

BACKGROUND OF THE INVENTION

The invention relates to a fuel distributor for fuel injection systems of internal combustion engines of the type defined hereinafter.

In such fuel distributors, as described for instance in German Patent 37 30 571, when the fuel injection valves are actuated by the impact of the valve needle on the impact plate that limits the needle stroke, considerable valve noise is generated when the valve opens, and this noise is carried to the valve body. In its upper and lower region the valve body is supported with large O-rings against the wall of the receiving bore; these O-rings on the one hand serve to provide fuel tightness of the fuel injection valves to the outside and on the other to acoustically decouple the valve carrier radially from the valve body. Via the body firmly fastened to the valve carrier of the valve holder, structure-borne sound still continues to be transmitted to the valve carrier and then onward through the valve supply line or the plug housing.

OBJECT AND SUMMARY OF THE INVENTION

The fuel distributor has an advantage that a complete acoustical decoupling of the fuel injection valve from the valve carrier is attained by the shaped ring made of elastomer. The acoustical decoupling is separate from the fuel sealing, which continues to be provided by O-rings. Any firm coupling between the valve body of the fuel injection valve and the valve carrier is thus avoided.

The invention will be better understood and further objects and advantages thereof will become more apparent from the ensuing detailed description of an exemplary embodiment taken in conjunction with the drawings.

DESCRIPTION OF THE PREFERRED EMBODIMENT

Figure 1:
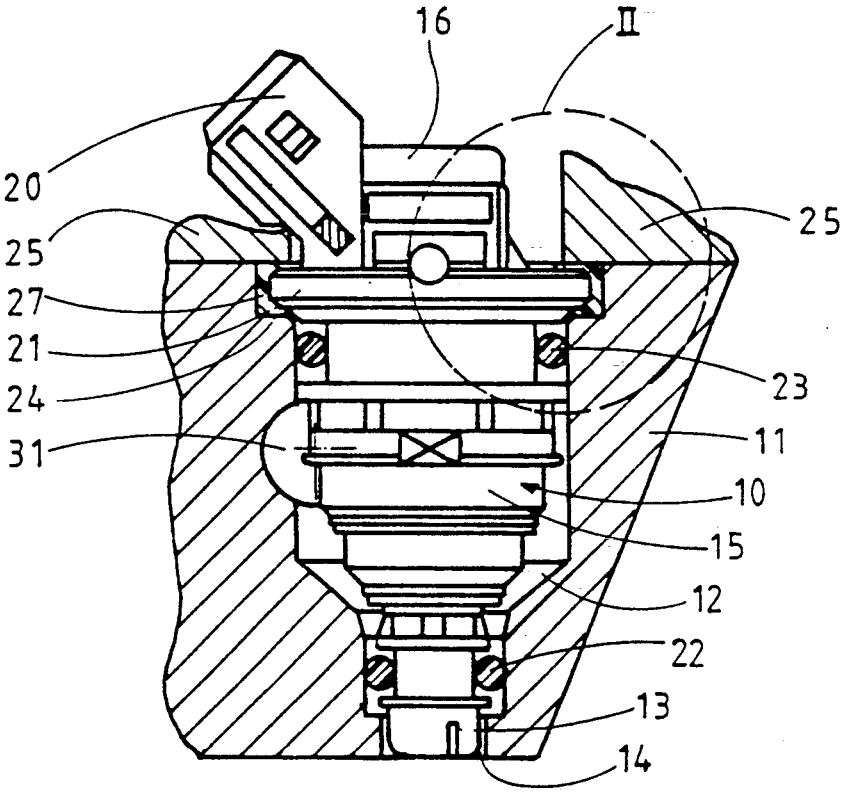
FIG. 1 is a detail in longitudinal section of a fuel distributor.

The fuel distributor shown in longitudinal section and only in part in FIG. 1 serves the purpose of retention, fuel supply and electrical contacting of electromagnetically actuatable fuel injection valves 10 in fuel injection systems of internal combustion engines. The valve distributor has a valve carrier 11 with stepped receiving bores 12, and carrier for each fuel injection valve 10. Each receiving bore 12, communicates with a fuel supply line 31 extending in the valve carrier and is embodied as a through bore and has a discharge opening 14 for the injection mouthpiece 13 of the fuel injection valve 10. The fuel injection valve 10 shown in part and in longitudinal section in FIG. 2 has a valve body or valve housing 15, which is closed off on the end by a plug housing 16. The valve needle, not visible here, and the electromagnet 17 for actuating the valve needle are accommodated in the valve housing 15. The ends of the exciter winding 18 of the electromagnet 17 are electrically conductively joined to plug prongs 19, which in the axial direction are electrically conductively connected, via contact elements in the plug housing 16, to connection lugs 20 that are accessible from outside the plug housing 16. With an end flange 26, the plug housing 16 rests on the annular end face 30 of the valve housing 15, and with an encompassing collar 21 on the end flange 26, it protrudes beyond the circumference of the valve housing 15.

With the fuel injection valve 10 inserted in the receiving bore 12, the valve housing 15 is supported radially on the bore wall of the receiving opening 12 via two large O-rings 22 and 23, serving to seal off the fuel injection valve 10 from the outside, of which the O-ring 22 is disposed near the injection mouthpiece 13 and the O-ring 23 is disposed near the plug housing 16; meanwhile the collar 21 on the end flange 26 of the plug housing 16 rests on a shaped ring 27 which rests on an annular bearing shoulder 24, surrounding the receiving bore 12, in the valve carrier 11. Fastening of the fuel injection valve 10 in the receiving bore 12 is effected by an upper end holder 25, which is shown only in part in FIG. 1 and is secured to the valve carrier 11 with an axial force of greater than 400 N. The holder 25 engages the shaped ring 27, on the rearward side of the end flange 26 remote from the valve housing 15, and also engages the surface of the valve carrier 11. The fuel injection valve 10 is thus fixed in the axial direction in the receiving bore 12.

Figure 2:
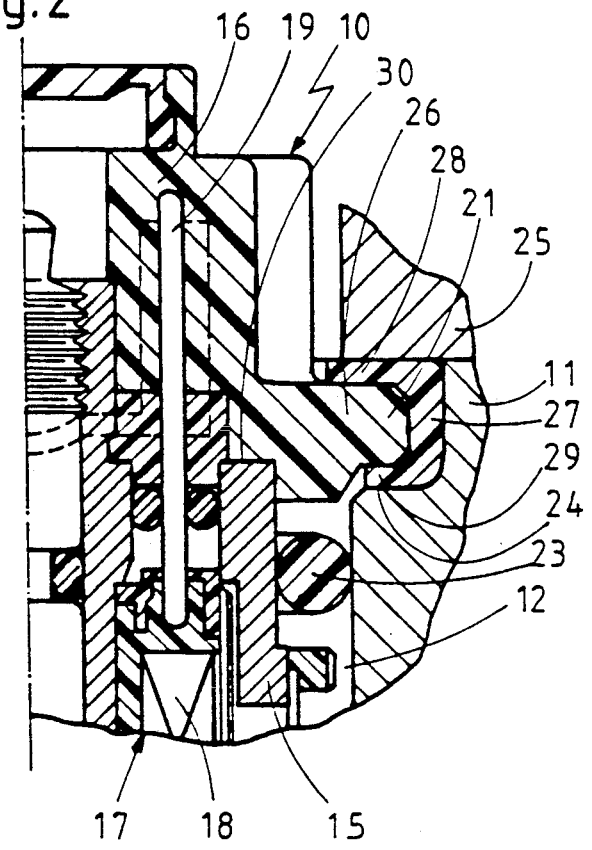
FIG. 2 is an enlarged sectional view of a partial detail of the fuel injection valve in the fuel distributor of FIG. 1.

For acoustic decoupling of the fuel injection valve 10 from the valve carrier 11, the collar 21 is surrounded by the shaped ring 27 made of the elastomer material, which fits over the collar 21 on both ends in the vicinity of the bearing surfaces of the bearing shoulder 24 and the holder 25. As can be seen in FIG. 2, the shaped ring 27 has a U-shaped profile, with legs 28, 29 of unequal length extending transversely to the axis of the ring, and the inside distance between which is equivalent to the axial thickness of the collar 21. The shaped ring 27 is fitted as a separate component over the collar 21 on the end flange 26, but it may also be integrally joined with the collar by a process in which the ring 27 is vulcanized directly onto the collar 21. By means of this shaped ring 27 and the O-rings 22, 23, any rigid connection between the fuel injection valve 10 and the valve carrier 11 is eliminated, and optimal acoustic decoupling is assured.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel distributor for fuel injection systems of internal combustion engines, having at least one fuel injection valve including a valve housing (15), a valve carrier (11) that has at least one axial, open, stepped bore (12) for receiving the at least one fuel injection valve, this bore communicating with a fuel supply line, a bearing shoulder (24) of said valve carrier (11) surrounding the receiving bore, said bearing shoulder (24) including a bearing surface, a collar (21) which forms a shoulder of the fuel injection valve housing (15), said collar (21) surrounded by a shaped ring (27) of an elastomer material, which fits over a portion of the collar (21) on upper and lower faces, said shoulder of said housing, said collar and said shaped ring firmly fastened by means of an end holder 25 at least in a vicinity of the bearing surface of the bearing shoulder (24) of said receiving bore.

2. A fuel distributor as defined in claim 1, in which said shaped ring (27) has a somewhat U-shaped profile, with legs (28, 29) which extend transversely to the ring axis and are spaced apart on the inside by a distance equivalent to an axial width of the collar.

3. A fuel distributor as defined by claim 1, in which said shaped ring (27) is integrally secured onto the collar (21).

4. A fuel distributor as defined by claim 2, in which said shaped ring (27) is integrally secured onto the collar (21).

5. A fuel distributor as defined by claim 1, in which said valve housing (15) is supported radially on a wall of the receiving bore (12) via at least one O-ring (22, 23).

6. A fuel distributor as defined by claim 2, in which said valve housing (15) is supported radially on a wall of the receiving bore (12) via at least one O-ring (22, 23).

7. A fuel distributor as defined by claim 3, in which said housing (15) is supported radially on a wall of the receiving bore (12) via at least one O-ring (22, 23).

8. A fuel distributor as defined by claim 4, in which said valve housing (15) is supported radially on a wall of the receiving bore (12) via at least one O-ring (22, 23).

9. A fuel distributor as defined by claim 1, in which said collar (21) is part of a plug housing (16), which is mounted on a face end (30) of said valve housing (15) of said fuel injection valve (10), the valve housing receiving a valve needle and an electromagnet (17), and said plug housing (16) includes electrical connection elements (19, 20) for an exciter winding (18) of the electromagnet (17).

10. A fuel distributor as defined by claim 2, in which said collar (21) is part of a plug housing (16), which is mounted on a face end (30) of said valve housing (15) of said fuel injection valve (10), the valve housing receiving a valve needle and an electromagnet (17), and said plug housing ((16) includes electrical connection elements (19, 20) for an exciter winding (18) of the electromagnet (17).

11. A fuel distributor as defined by claim 3, in which said collar (21) is part of a plug housing (16), which is mounted on a face end (30) of said valve housing (15) of said fuel injection valve (10), the valve housing receiving a valve needle and an electromagnet (17), and said plug housing ((16) includes electrical connection elements (19, 20) for an exciter winding (18) of the electromagnet (17).

12. A fuel distributor as defined by claim 4, in which said collar (21) is part of a plug housing (16), which is mounted on a face end (30) of said valve housing (15) of said fuel injection valve (10), the valve housing receiving a valve needle and an electromagnet (17), and said plug housing ((16) includes electrical connection elements (19, 20) for an exciter winding (18) of the electromagnet (17).

13. A fuel distributor as defined by claim 5, in which said collar (21) is part of a plug housing (16), which is mounted on a face end (30) of said valve housing (15) of said fuel injection valve (10), the valve housing receiving a valve needle and an electromagnet (17), and said plug housing ((16) includes electrical connection elements (19, 20) for an exciter winding (18) of the electromagnet (17).

14. A fuel distributor as defined by claim 6, in which said collar (21) is part of a plug housing (16), which is mounted on a face end (30) of said valve housing (15) of said fuel injection valve (10), the valve housing receiving a valve needle and an electromagnet (17), and said plug housing ((16) includes electrical connection elements (19, 20) for an exciter winding (18) of the electromagnet (17).

15. A fuel distributor as defined by claim 7, in which said collar (21) is part of a plug housing (16), which is mounted on a face end (30) of said valve housing (15) of said fuel injection valve (10), the valve housing receiving a valve needle and an electromagnet (17), and said plug housing ((16) includes electrical connection elements (19, 20) for an exciter winding (18) of the electromagnet (17).

16. A fuel distributor as defined by claim 8, in which said collar (21) is part of a plug housing (16), which is mounted on a face end (30) of said valve housing (15) of said fuel injection valve (10), the valve housing receiving a valve needle and an electromagnet (17), and said plug housing ((16) includes electrical connection elements (19, 20) for an exciter winding (18) of the electromagnet (17).

17. A fuel distributor as set forth in claim 1 in which said collar (21) is a part of said valve housing and firmly joined thereto.

18. A fuel distributor as set forth in claim 2 in which said collar (21) is a part of said valve housing and firmly joined thereto.

19. A fuel distributor as set forth in claim 5 in which said collar (21) is a part of said valve housing and firmly joined thereto.

20. A fuel distributor as set forth in claim 6 in which said collar (21) is a part of said valve housing and firmly joined thereto.

* * * * *